US008497055B2

(12) United States Patent
Kikushima

(10) Patent No.: US 8,497,055 B2
(45) Date of Patent: Jul. 30, 2013

(54) ELECTROSTATIC CHARGE DEVELOPING TONER, ELECTROSTATIC CHARGE DEVELOPING DEVELOPER, AND IMAGE FORMING APPARATUS

(75) Inventor: Seiji Kikushima, Osaka (JP)

(73) Assignee: Kyocera Mita Corporation (JP)

( * ) Notice: Subject to any disclaimer, the term of this patent is extended or adjusted under 35 U.S.C. 154(b) by 225 days.

(21) Appl. No.: 13/223,565

(22) Filed: Sep. 1, 2011

(65) Prior Publication Data

US 2012/0058424 A1 Mar. 8, 2012

(30) Foreign Application Priority Data

Sep. 3, 2010 (JP) ..... 2010-197942

(51) Int. Cl.
*G03G 9/08* (2006.01)

(52) U.S. Cl.
USPC ..... 430/110.1; 430/108.1; 430/110.3

(58) Field of Classification Search
USPC ..... 430/110.1, 108.1, 110.3
See application file for complete search history.

(56) References Cited

U.S. PATENT DOCUMENTS

2007/0202426 A1 8/2007 Kikushima

FOREIGN PATENT DOCUMENTS

| | | |
|---|---|---|
| JP | 2008-145661 | 6/2008 |
| JP | 2008-225311 | 9/2008 |
| JP | 2009-251092 | 10/2009 |

*Primary Examiner* — Mark A Chapman

(74) *Attorney, Agent, or Firm* — Gerald E. Hespos; Michael J. Porco; Matthew T. Hespos

(57) ABSTRACT

To provide an electrostatic charge developing toner in which resin fine particles and inorganic fine particles are externally added to toner base particles, wherein the toner base particles include at least binder resin and colorant, the resin fine particles are monodispersed and fixed to surfaces of the toner base particles, and following equations are established: a=70 to 160 nm, b/a=0.2 to 0.5, and c/a=0.6 to 0.8, where "a" represents an average of diameters (nm) of circular surfaces of contact between the fixed resin fine particles and toner base particle surfaces, "b" represents an average of heights (nm) of the resin fine particles from the contact surfaces, and "c" represents an average diameter (nm) of the resin fine particle at the height b/2.

8 Claims, 1 Drawing Sheet

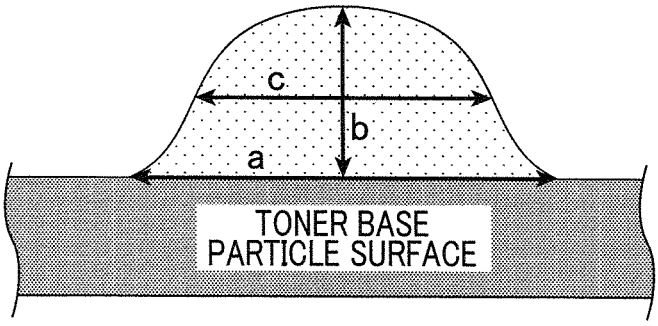
c
b
a
TONER BASE
PARTICLE SURFACE

ELECTROSTATIC CHARGE DEVELOPING TONER, ELECTROSTATIC CHARGE DEVELOPING DEVELOPER, AND IMAGE FORMING APPARATUS

BACKGROUND OF THE INVENTION

1. Field of the Invention

The present disclosure relates to an electrostatic charge developing toner, electrostatic charge developing developer, and image forming apparatus that are used in an electrophotographic system.

2. Description of the Related Art

In an electrophotographic image forming apparatus for forming an image on a sheet, such as a copier, a printer, or a digital multi-functional peripheral, an electrostatic image (electrostatic latent image) is formed on a circumferential surface of a photoreceptor drum serving as an image carrier, and is then developed into a toner image by a developing device using a toner. The toner image on the photoreceptor drum is transferred to a sheet by a transfer device, and then heated, pressurized, and fixed to the sheet by a fixing device. The sheet having the toner image fixed thereto is eventually discharged to the outside of the image forming apparatus.

Deformed resin fine particles are fixed to the surfaces of toner particles of the toner used in the above-described electrophotographic system in recent years, in order to prevent the resin fine particles from adhering to a developing sleeve or photoreceptor drum and stabilize image quality over a long period of time.

In order to cope with toner fixation at low temperatures and increasing the image quality resulting from increased speeds and energy saving of digital multi-functional peripherals and printers, a toner used in an electrophotographic process is gradually reduced in diameter and consequently subjected to thermal stress and physical stress, easily changing the state of the toner (change in shape of the toner and how an external additive is buried). This change in state causes a change in the performance of each process, narrowing the design margins and causing other troubles. Therefore, it is important to control such change in state in order to maintain image quality.

The greatest impact of the change in state causes fogging and scattering of the toner due to defective charging of the toner, which is caused when replenished toner having high electrostatic chargeability is mixed with a toner having low electrostatic chargeability that is generated when inorganic fine particles as the external additive are buried in toner base particles when mixing a developer.

For this reason, the resin fine particles are added in order to prevent the occurrence of the defective charging. This is because the resin fine particles, unlike the inorganic fine particles, are effective in preventing the defective charging by its similarity in charging system with a binder resin of the toner. Particularly, although the resin fine particles have low positive charging characteristics in the beginning when being mixed with a carrier, the positive charging characteristics gradually increase, and consequently the resin fine particles prevent a change in charging caused by the inorganic fine particles and effectively preventing the occurrence of fogging or scattering during images are formed.

An electrostatic charge developing toner has been reported as the toner having the resin fine particles fixed to the surface thereof. Organic fine particles with a number average particle diameter which is at least 50 nm but less than or equal to 200 nm and a variation of shape coefficient SF-1 equal to or lower than 10% before and after a forcible stirring test, are externally added to the toner. The glass-transition temperature of this toner is at least 20° C. but less than or equal to 45° C.

The known conventional technology described above, however, exerts a spacer effect by fixing special hard resin fine particles, not deformed, to a toner surface to ensure stable fixation performance or transfer performance. Adding the resin fine particles is not to prevent defective charging.

In addition, the specific gravity of the resin fine particles is normally approximately 1 to 1.2 g/cm$^3$, which is too low to fix the resin fine particles to the toner surface. Consequently, the resin fine particles easily separate from the toner surface. Due to the low hardness of the resin fine particles, the resin fine particles are deformed easily and adhere to the carrier, developing sleeve, photoreceptor drum and other toner carriers, causing a defective image.

The present disclosure was contrived in view of the circumstances described above, and an object thereof is to provide a toner in which resin fine particles are fixed to a toner surface such that the resin fine particles are deformed when added thereto, and in which defective charging and toner carrier contamination are prevented by controlling the level of deformation.

SUMMARY OF THE INVENTION

As a result of the keen investigation, the present inventors have found that the object described above can be accomplished by using an electrostatic charge developing toner having the following configurations, and have completed the present disclosure after a great deal of investigations based on such a finding.

In other words, one aspect of the present disclosure is an electrostatic charge developing toner in which resin fine particles and inorganic fine particles are externally added to toner base particles, wherein the toner base particles include at least binder resin and colorant, the resin fine particles are monodispersed and fixed to surfaces of the toner base particles, and following equations are established: a=70 to 160 nm, b/a=0.2 to 0.5, and c/a=0.6 to 0.8, where "a" represents an average of diameters (nm) of circular surfaces of contact between the fixed resin fine particles and toner base particle surfaces, "b" represents an average of heights of the resin fine particles (nm) from the contact surfaces, and "c" represents an average diameter (nm) of the resin fine particle at the height b/2.

Another aspect of the present disclosure is an electrostatic charge developing developer that includes the electrostatic charge developing toner and a carrier. According to this configuration, an electrostatic charge developing developer capable of achieving the various effects described above can be obtained.

Yet another aspect of the present disclosure is an image forming apparatus that uses the electrostatic charge developing toner or the electrostatic charge developing developer. According to this configuration, an image forming apparatus capable of achieving the various effects described can be obtained.

BRIEF DESCRIPTION OF THE DRAWINGS

FIG. 1 is a schematic diagram showing an example of fixing resin fine particles to toner base particle surfaces.

DETAILED DESCRIPTION OF THE PREFERRED EMBODIMENTS

[Electrostatic Charge Developing Toner]

An electrostatic charge developing toner according to a present embodiment is configured such that resin fine particles and inorganic fine particles are externally added to toner base particles. The toner base particles include at least binder resin and colorant. The resin fine particles are monodispersed and fixed to surfaces of the toner base particles, and equations a=70 to 160 nm, b/a=0.2 to 0.5 and c/a=0.6 to 0.8 are established, where "a" represents an average of diameters (nm) of circular contact surfaces between the fixed resin fine particles and the surfaces of the toner base particles, "b" represents an average of heights of the resin fine particles (nm) from the contact surfaces, and "c" represents an average diameter (nm) of the resin fine particle at the height b/2.

According to the configuration described above, the following effects can be achieved. First of all, externally adding the resin fine particles and inorganic fine particles to the toner can enhance the fluidity of the toner and favorably prevent the occurrence of defective charging caused by the inorganic fine particles. By deforming the resin fine particles and appropriately fixing the deformed resin fine particles to the toner surfaces can prevent the resin fine particles from adhering to a developing sleeve or a photoreceptor drum. In this manner, the occurrence of both defective charging and contamination of toner carrier can be prevented, stabilizing the image quality over a long period of time.

The toner base particles and external additives (the resin fine particles and the inorganic fine particles) thereof that constitute the toner of the present embodiment are described hereinafter in detail.

<Toner Base Particles>

The toner base particles are obtained by blending binder resin with a colorant and a release agent, or a charge-controlling agent etc. The toner base particles are produced by, for example, mixing these ingredients in a blender, melting and kneading the mixture using an extruder, cooling the mixture, and pulverizing and sorting thus obtained solid matter. The volume average particle diameter of the toner base particles is 2 to 12 μm, preferably 4 to 10 μm, and more preferably 6 to 8 μm.

(Binder Resin)

A binder resin of toner base particles conventionally used as binder resin may be used as binder resin of the present embodiment with no particular restriction. Specific examples of such a binder resin include styrene resin, acrylic resin, styrene-acrylic resin, polyethylene resin, polypropylene resin, vinyl chloride resin, polyester resin, polyamide resin, polyurethane resin, polyvinyl alcohol resin, vinyl ether resin, N-vinyl resin, styrene-butadiene resin, and other thermoplastic resins. These binder resins may be used alone or in combinations of two or more thereof.

It is preferred that any of the above-mentioned thermoplastic resins be used as the binder resin of the present embodiment in terms of obtaining favorable fixation properties. However, it is not necessary to use the thermoplastic resin only, but a cross-linking agent may be added thereto, or thermosetting resin may be used as part of binder resin. Introducing a cross-linking structure into a part of the binder resin can improve storage stability and form retention properties of the toner without lowering the fixation properties.

Examples of the thermosetting resin usable in the present embodiment include bisphenol A epoxy resin, hydrogenated bisphenol A epoxy resin, novolac-type epoxy resin, polyalkylene ether-type epoxy resin, cyclic aliphatic epoxy resin, cyanate resin and so on. These thermosetting resins may be used alone or in combinations of two or more thereof.

The glass-transition temperature of the binder resin is preferably, for example, 50 to 70° C. and more preferably 55 to 65° C. When the glass-transition temperature of the binder resin is less than 50° C., toners might become fused to each other in a developing device during the operation of an image forming apparatus or in a toner container when the toners are stored or transported, lowering the storage stability of the toner. On the other hand, the glass-transition temperature exceeding 70° C. might lower the low-temperature fixation properties of the toners.

(Colorant)

Colorant for monochrome toner or color toner conventionally used as a colorant may be used as a colorant of the present embodiment. Specific examples of such a colorant include a black pigment such as carbon black, a yellow pigment such as pigment yellow 180, an orange pigment such as molybdenum orange, a red pigment such as C.I. pigment red 238, a purple pigment such as methyl violet lake, a blue pigment such as phthalocyanine blue, a green pigment such as pigment green B, and various other dyes.

In the present embodiment, the content of each above-indicated colorant in 100 parts by mass of the binder resin is, for example, 1 to 15 parts by mass.

Note that in the present embodiment, a developer containing the toner may be a one-component developer that includes not a carrier but a toner, or may be a two-component developer that contains both toner and carrier. The toner used in the one-component developer is usually magnetic toner used in an image forming apparatus using a magnetic one-component developing system. In the magnetic toner, magnetic powder is used as the colorant contained in the toner. The colorant contained in the magnetic toner may contain the colorants such as the pigments or dyes described above other than the magnetic powder. Magnetic powder of a conventional magnetic toner may be used as the abovementioned magnetic powder, with no restriction. Specific examples thereof include ferromagnetic metals such as iron, cobalt and nickel, an alloy having the metals, compounds having elements constituting the metals and alloys, alloys that do not include elements constituting the metals and the alloys but have ferromagnetic property by being thermally processed appropriately, and chromium dioxide. Above all, the compounds having elements constituting the metals and the alloys are preferred, and ferrite and magnetite are particularly preferred. When using the magnetic powder as the colorant, the content of the magnetic powder is preferably, for example, approximately 40 to 100 parts by mass with respect to 100 parts by mass of the binder resin.

(Release Agent)

In the present embodiment, a release agent may be added in order to improve toner fixation properties and prevent a decrease of toner offset properties. In the present embodiment, a conventionally-used release agent for toner base particles may be used as a release agent of the present embodiment, with no restriction. Specific examples of such a release agent include polyethylene wax, polypropylene wax, Teflon™ wax, Fischer-Tropsch wax, paraffin wax, ester wax, carnauba wax, montan wax, rice wax and so on. These release agents may be used alone or in combinations of two or more thereof.

In the present embodiment, the content of the release agent is, for example, 1 to 10 parts by mass with respect to 100 parts by mass of the binder resin. When the content of the release agent is less than 1 part by mass, the toner fixation properties cannot be improved, and a decrease in the toner offset properties cannot be prevented. When, on the other hand, the content of the release agent exceeds 10 parts by mass, the toners become fused to each other, lowering the toner storage stability.

(Charge-Controlling Agent)

In the present embodiment, a charge-controlling agent may be added in order to maintain a toner charge amount and improve charge rising properties (ability to charge the toner up to a predetermined charge amount in a short amount of time). When positively charging the toner to prepare for development, a charge-controlling agent with positive charging properties is used; and when negatively charging the toner to prepare for development, a charge-controlling agent with negative charging properties is used.

A conventionally-used charge-controlling agent with positive charging properties for toner base particles may be used as a charge-controlling agent with positive charging properties of the present embodiment, with no restriction. Specific examples of such a charge-controlling agent include pyridazine, pyrimidine, pyrazine, orthoxazine, methoxazine, paroxazine, orthothiazine, meth thiazine, parathiazine, 1,2,3-triazine, and other azine compounds. These charge-controlling agents may be used alone or in combinations of two or more thereof.

A conventionally-used charge-controlling agent with negative charging properties for toner base particles may be used as a charge-controlling agent with positive charging properties of the present embodiment, with no restriction. Specific examples of such a charge-controlling agent include organic metal complexes such as acetylacetone metal complex and salicylic metal complex, and, chelate compounds such as aluminum acetylacetonate, irone (II) acetylacetonate. These charge-controlling agents may be used alone or in combinations of two or more thereof.

In the present embodiment, the content of the charge-controlling agent is, for example, 0.5 to 15 parts by mass with respect to 100 parts by mass of the binder resin. When the content of the charge-controlling agent is less than 0.5 parts by mass, the image density of a formed image becomes low, increasing fogging in the formed image. On the other hand, the charge-controlling agent exceeding 15 parts by mass tends to cause defective charging/defective image under high temperature and humidity.

<External Additives>

(Resin Fine Particles)

The external additives are the major characteristics of the present embodiment. The resin fine particles are externally added to the toner according to the present embodiment.

The resin fine particles according to the present embodiment are monodispersed and fixed to the surfaces of the toner base particles described above. In other words, the resin fine particles are dispersed and fixed to the surfaces of the toner base particles without aggregating into one. The effects of the present disclosure cannot be accomplished if the resin fine particles aggregate.

In the present embodiment, the resin fine particles are deformed in a range where a=70 to 160 nm, b/a=0.2 to 0.5 and c/a=0.6 to 0.8 are established, where "a" represents the average of diameters (nm) of circular contact surfaces between the fixed resin fine particles and the surfaces of the toner base particles, "b" represents the average of heights of the resin fine particles (nm) from the contact surfaces, and "c" represents the diameter (nm) of the resin fine particle at the height b/2 (see FIG. 1). When the resin fine particles are fixed in the deformed state as described above, the area of contact between the resin fine particles and the toner surfaces increases, and the resin fine particles are prevented from being detached from the toner surfaces and adhering to the developing sleeve or the photoreceptor drum, which results in stabilizing the image quality over a long period of time. "Diameters (nm) of circular contact surfaces" indicates diameters of a circular having the same planar dimension as the contact surface between the fixed resin fine particles and the surfaces of the toner base particles.

When c/a exceeds 0.8, the resin fine particles are easily detached from the toner surfaces. When c/a is 0.6 or more but b/a exceeds 0.5, the resin fine particles are easily detached from the toner surfaces as well. When b/a is below 0.2, the toner chargeability cannot be stabilized, lowering the effect of preventing the occurrence of defective charging. Furthermore, the effect of preventing the occurrence of defective charging is low when a is greater than 160 nm. When a is less than 70 nm, a large amount of emulsifier is required in order to adjust the particle diameter. As a result, the resin fine particles are easily deformed and b/a cannot be controlled to be at least 0.2.

Examples of the way to "fix" the resin fine particles include fixation by mechanical impact, thermal fusion bonding, adhesion and so on.

The average a (nm) of the diameters of the circular contact surfaces between the resin fine particles and the toner base particle surfaces, the average b (nm) of the heights of the resin fine particles from the contact surfaces, and the diameter c (nm) of the resin fine particle at the height b/2, can be obtained by capturing a side view image of the surface of 10 toner particles with the resin fine particles fixed thereon, at an accelerating voltage of 0.5 Kv and 100.000-fold magnification using, for example, a field emission electron scanning microscope JSM-7401F manufactured by JEOL Ltd; and by measuring the values of a, b and c and calculating the average values thereof.

Next is described a resin material that constitutes the resin fine particles used in the present embodiment.

The resin similar to that of the binder resin of the toner base particles described above can be used with no particular restriction as the resin of the resin fine particles.

Specific examples include styrene resin, acrylic resin, styrene-acrylic resin, polyethylene resin, polypropylene resin, vinyl chloride resin, polyester resin, polyamide resin, polyurethane resin, polyvinyl alcohol resin, vinyl ether resin, N-vinyl resin, styrene-butadiene resin, and other thermoplastic resins. Styrene-acrylic resin is particularly preferred in terms of achieving stable charging.

It is preferred that the average primary particle diameter of the resin fine particles is 40 to 140 nm and more preferably 50 to 125 nm. These ranges can allow the resin fine particles to be fixed to the toner base particles with appropriate strength, so that the image quality can be securely stabilized over a long period of time and the operation of fixing the resin fine particles to the toner base particles can be performed easily. When the particle diameter is less than 40 nm, a large amount of emulsifier with low heat-resistance is required, deforming the resin fine particles extremely. When the particle diameter exceeds 140 nm, the resin fine particles cannot be fixed to the toner surfaces, causing the resin fine particles to be detached from the toner surfaces and contaminate toner carriers such as developing sleeve and photoreceptor drum. Note that the average primary particle diameter of the resin fine particles can be measured using, for example, a field emission electron scanning microscope (manufactured by JEOL Ltd., JSM-7700F).

It is preferred that the resin fine particles be added in the amount of 0.05 to 2 parts by mass with respect to 100 parts by mass of the toner base particles. When the amount of resin fine particles added is less than 0.05 parts by mass, stable charging cannot be accomplished. When the amount of resin fine particles added exceeds 2 parts by mass, the fixation properties become impaired, contaminating the toner carriers and lowering the image quality.

Examples of a method of producing the resin fine particles used in the present embodiment include, but not particularly limited to, an emulsion polymerization method and radical polymerization method. The emulsion polymerization is particularly preferred.

More specifically, for the emulsion polymerization method, for example, a solution added with an emulsifier such as sodium lauryl sulfate and a polymerization initiator such as ammonium persulfate is prepared. Next, the resin fine particles described above are dropped into this solution to obtain an emulsion. Finally, the emulsion is dried, to obtain the resin fine particles.

(Method of Fixing the Resin Fine Particles)

A method for fixing the resin fine particles to the toner base particles is not particularly limited as long as it is a method for monodispersing and fixing the resin fine particles to the toner base particles such that equations: a=70 to 160 nm, b/a=0.2 to 0.5 and c/a=0.6 to 0.8 are established, where "a" represents the average of the diameters (nm) of the circular contact surfaces between the fixed resin fine particles and the surfaces of the toner base particles, "b" represents the average of the heights of the resin fine particles (nm) from the contact surfaces, and "c" represents the diameter (nm) of the resin fine particle at the height b/2.

Examples of the method for fixing the resin fine particles include fixation by mechanical impact, thermal fusion bonding, adhesion and so on. More specific examples include the methods described in the following examples.

(Inorganic Fine Particles)

The toner according to the present embodiment further includes inorganic fine particles as the external additive. Having the inorganic fine particles as the external additive, the fluidity of the developer can be appropriately adjusted.

Inorganic fine particles that are conventionally used as an external additive of toner base particles may be used as the inorganic fine particles, with no particular restriction. More specifically, inorganic fine particles such as silica, aluminum oxide or magnetite etc. that can be used as a fluidizer, and titanium oxide etc. used as a polish can be used. Above all, silica fine particles are particularly preferred in terms of securely contributing to chargeability and adjusting the fluidity of the toner.

Specific examples of the silica fine particles include fumed silica produced by dry-type high-temperature hydrolysis method (a method for evaporating silicon chloride such as silicon tetrachloride to synthesize the silica fine particles by a gas-phase reaction in a high-temperature hydrogen flame), silica produced by a deflagration method (a dry method for oxidizing silicon in an oxygen stream and vaporizing the silicon using reaction heat and then cooling it, to synthesize the silica fine particles), silica produced by a sol-gel method (a wet method for synthesizing the silica fine particles by hydrolysis of alkoxysilane), and silica produced by a colloidal method (a wet method for synthesizing the silica fine particles by hydrolysis of liquid glass).

The surfaces of the inorganic fine particles may be hydrophobized by silicone oil, aminosilane, hexamethyldisilazane and other silane coupling agents, or by titanate coupling agents etc. More specifically, the silica fine particles can be hydrophobized, for example, by silicone oil such as dimethylpolysiloxane.

The average primary particle diameter of the inorganic fine particles used in the present embodiment is normally 7 to 500 nm and preferably 12 to 120 nm. When the particle diameter of the inorganic fine particles is less than 7 nm, the inorganic fine particles may be easily buried into the toner base particles. As a result, the fluidity of the toner drops, and consequently the toner cannot spatter from the toner carriers easily, lowering the density of a formed image. When the particle diameter of the inorganic fine particles exceeds 500 nm, the inorganic fine particles are easily detached from the toner base particles and contaminate the toner carriers, causing a defective image.

It is preferred that the amount of inorganic fine particles added be 0.4 to 10 parts by mass with respect to 100 parts by mass of the toner base particles. When the amount of inorganic fine particles added is less than 0.4 parts by mass, the fluidity of the toner becomes low and the toner cannot spatter easily from the toner carriers, lowering the density of a formed image. When the amount of inorganic fine particles added exceeds 10 parts by mass, the toner spatter too easily from the toner carriers, whereby the toner scatters from the developing device, causing fogging in the formed image.

The inorganic fine particles are externally added to the toner base particles by, for example, stirring and mixing the toner base particles with the inorganic fine particles by means of a dry method. In this case, the stirring and mixing described above is preferably performed using a Henschel blender, turbula blender, super blender or the like so that the inorganic fine particles are not buried in the toner base particles. The inorganic fine particles may be added externally at the same time when fixing the said resin fine particles to toner base particles.

The resin fine particles and the inorganic fine particles described above are used as the external additives of the toner, and the resin fine particles are fixed to the surfaces of the resin fine particles so as to be deformed. The level of the deformation is controlled in order to prevent the occurrence of defective charging and contamination of the toner carriers and the like during image formation. As a result, the image quality can be maintained over a long period of time.

[Electrostatic Charge Developing Developer]

As described above, the electrostatic charge developing toner according to the present disclosure can be used alone as a one-component developer or mixed with a carrier to form a two-component developer. In other words, the one-component developer is an electrostatic charge developing developer that includes the electrostatic charge developing toner having the configurations described above, and the two-component developer is an electrostatic charge developing developer that includes the electrostatic charge developing toner having the configurations described above and a carrier. The two-component developer is mainly described hereinafter. The one-component developer also corresponds to the following description.

<Carrier>

A conventionally-used carrier of a two-component developer may be used with no particular restriction as a carrier of the present embodiment. Specific examples of the carrier include the one in which a surface of a carrier core material is coated with resin.

Examples of the carrier core material include metallic metals such as iron, nickel and cobalt; alloys thereof; alloys containing rare earths; soft ferrite such as hematite, magnetite, manganese-zinc ferrite, nickel-zinc ferrite, manganese-magnesium ferrite, and lithium ferrite; ferrioxides such as copper-zinc ferrite; and magnetic particles that are produced by sintering or atomizing magnetic materials such as a mixture of the abovementioned materials.

Examples of the available resin used for coating the surface of the carrier core material include fluorine resins such as polytetrafluoroethylene, polychlorotrifluoroethylene, polyvinylidene fluoride, tetrafluoroethylene/hexafluoropropyrene copolymer (FEP), and tetrafluoroethylene/perfluoroalkoxyethylene copolymer (PFA), polyamide-imide resin, acrylic resin, and straight silicon.

The particle diameter of the carrier is 15 to 100 μm, preferably 20 to 70 μm, and more preferably 25 to 50 μm when seen with an electron microscope. The apparent relative gravity of the carrier varies depending on the compositions of the magnetic materials, surface structure or the like but is preferably within a range of 3000 to 8000 kg/m3 in general.

The two-component developer can be prepared by stirring and mixing the toner and carrier using a ball mill by means of a dry method. The toner density of the two-component developer is 3 to 20 mass %, preferably 5 to 15 mass %, and more preferably 6 to 10 mass %. When the toner density is less than 3 mass %, the density of a formed image may become excessively low. When the toner density exceeds 20 mass %, the toner may scatter from the developing device during the operation of the image forming apparatus, causing fogging in the formed image and contaminating the inside of the image forming apparatus.

[Image Forming Apparatus]

The image forming apparatus according to the present disclosure uses the electrostatic charge developing toner having the above-described configurations alone as the one-component developer or as the two-component developer in which the electrostatic charge developing toner having the above-described configurations is mixed with the carrier. The image forming apparatus generally has a photoreceptor drum (image carrier) having an electrostatic charge image (electrostatic latent image) formed on a circumferential surface thereof, and a developing device that uses the toner to develop the electrostatic charge image on the photoreceptor drum. In the present disclosure, the toner is the electrostatic charge developing toner having the configurations described above.

A charging device, an exposure device, the developing device, a transfer device and a cleaning device are disposed around the photoreceptor drum.

An organic photoreceptor (OPC) or amorphous silicon photoreceptor is usually used as the photoreceptor drum, and especially the long-lasting amorphous silicon photoreceptor is preferably used. The charging device generates corona discharge and provides a predetermined potential to the circumferential surface of the photoreceptor drum. The exposure device emits light based on image data and thereby selectively attenuates the potential of the circumferential surface of the photoreceptor drum, to form an electrostatic charge image. The developing device forms a toner image by developing the electrostatic charge image on the circumferential surface of the photoreceptor drum using the toner. The transfer device transfers the toner image, formed on the photoreceptor drum, to a sheet. The cleaning device removes the toner and the like remaining on the circumferential surface of the photoreceptor drum after transferring the toner image onto the sheet by the transfer device.

The image forming apparatus further has a fixing device having a heating roller and pressure roller. The fixing device fixes the toner image to the sheet by heating and pressurizing the sheet having the toner image transferred thereto.

In the case of the two-component developer containing the toner and the carrier, the developing device has a housing for storing the two-component developer, stirring roller provided rotatably within the housing, magnetic roller, and developing roller (toner carrier).

The stirring roller charges a newly replenished toner while stirring it, and disperses this toner evenly in the two-component developer. The magnetic roller carries the two-component developer, fed from the stirring roller, on a circumferential surface thereof in the form of a magnetic brush. Note that a control blade for controlling the thickness of the magnetic brush on the magnetic roller is disposed around the magnetic roller. The developing roller, disposed in the vicinity of the magnetic roller, moves only the toner from the magnetic brush on the magnetic roller to a circumferential surface of the developing roller, to form a toner thin layer thereon. The developing roller, disposed a predetermined distance away from the photoreceptor drum to face the photoreceptor drum, allows the toner to move from the toner thin layer to the circumferential surface onto the photoreceptor drum (this movement includes flying of the toner from the circumferential surface of the developing roller to the circumferential surface of the photoreceptor drum that are separated from each other (touchdown system)), to develop the electrostatic charge image on the photoreceptor drum.

The image forming apparatus may be used for the one-component developer or may be a tandem type color image forming apparatus that has an intermediate transfer belt where toner images of corresponding colors are overlapped on each other into one toner image before a color image is transferred to a sheet.

EXAMPLES

The present disclosure is described in further detail using examples. Note that the present disclosure is not limited to these examples.

[Production of Developer]

(Preparation of Silica A)

Dimethylpolysiloxane in the amount of 100 g and 3-aminopropyltrimethoxysilane in the amount of 100 g (both manufactured by Shin-Etsu Chemical Co., Ltd.) were dissolved in 200 g of toluene, which was then diluted to 10 times. Next, 200 g of fumed silica (product name: Aerosil #90 (manufactured by Nippon Aerosil Co., Ltd.)) was stirred and the obtained diluted solution was gradually dropped thereto, then the solution was subjected to ultrasonic irradiation and stirring for 30 minutes to obtain a mixture. This mixture was heated in a high-temperature tank at 150° C., and, thereafter, the toluene was distilled and removed by a rotary evaporator. The resultant solid matter was dried by a reduced-pressure dryer at a set temperature of 50° C. until the solid matter no longer decreases in amount. Thus obtained product was heated at 200° C. for three hours in a nitrogen stream in an electric furnace. The resultant powder was pulverized by a jet mill and collected by a bag filter, to obtain silica A having a primary particle diameter of 20 nm.

(Preparation of Resin Fine Particle A)

Deionized water in the amount of 200 parts by mass and sodium lauryl sulfate in the amount of 4 parts by mass were injected into a glass reactor installed with a thermometer, reflux condenser, nitrogen gas introducing pipe and agitator, and then heated at 80° C. in a nitrogen-gas atmosphere. Ammonium persulfate in the amount of 1 part by mass was added to the reactor while the content therein was stirred, and then a monomer mixture composed of methyl methacrylate in the amount of 45 parts by mass, styrene in the amount of 50 parts by mass, and divinylbenzene in the amount of 5 parts by mass was dropped into the reactor for one hour, and then stirred for one hour. The resultant emulsion was dried to obtain resin fine particles A having an average particle diameter of 65 nm.

(Preparation of Resin Fine Particles B)

Resin fine particles B having an average particle diameter of 93 nm were obtained in the same manner as how the resin fine particles A were obtained, except that the amount of sodium lauryl sulfate was changed from 4 parts by mass to 2 parts by mass.

(Preparation of Resin Fine Particles C)

Resin fine particles C having an average particle diameter of 52 nm were obtained in the same manner as how the resin fine particles A were obtained, except that the amount of sodium lauryl sulfate was changed from 4 parts by mass to 6 parts by mass.

(Preparation of Resin Fine Particles D)

Resin fine particles D having an average particle diameter of 123 nm were obtained in the same manner as how the resin fine particles A were obtained, except that the amount of sodium lauryl sulfate was changed from 4 parts by mass to 1 part by mass.

(Preparation of Resin Fine Particles E)

Resin fine particles E having an average particle diameter of 80 nm were obtained in the same manner as how the resin fine particles A were obtained, except that the amount of methyl methacrylate was changed to 50 parts by mass and divinylbenzene was not added.

(Preparation of Resin Fine Particles F)

Resin fine particles F having an average particle diameter of 88 nm were obtained in the same manner as how the resin fine particles A were obtained, except that the amount of methyl methacrylate was changed to 40 parts by mass and the amount of divinylbenzene was changed to 10 parts by mass.

(Preparation of Toner Base Particles A)

Styrene-acrylic resin in the amount of 100 parts by mass as the binder resin, paraffin wax (separating agent) in the amount of 4 parts by mass, Nipex 60 (manufactured by Degussa) in the amount of 12 parts by mass as the colorant, FCA-1001-NS (manufactured by Fujikura Kasei Co., Ltd.) in the amount of 1 part by mass as the charge-controlling agent were added respectively into a Henschel blender and mixed together. The mixture was then melted and kneaded by a twin screw extruder and cooled by a drum flaker. Subsequently, the obtained product was roughly pulverized by a hammer mill, finely pulverized by a turbo mill, and sorted using a wind classifier, to prepare toner particles A having a volume average particle diameter of 6.81 μm and average circularity of 0.951.

(Preparation of Carrier A)

After diluting 30 g of polyamide-imide resin in 2-liter water, tetrafluoroethylene/hexafluoropropyrene copolymer (FEP) in the amount of 120 g was dispersed therein, and silicon oxide in the amount of 3 g was then dispersed therein, to obtain coating layer forming liquid. This coating layer forming liquid and 10 kg of non-coated ferrite EF-35B (manufactured by Powdertech Co., Ltd., 35 μm) were introduced into a fluid bed coating device to perform coating. Subsequently, the obtained product was burnt at 250° C. for one hour, to obtain a carrier A.

(Preparation of Developer A)

The silica A in the amount of 40 g and the resin fine particles A in the amount of 20 g were added to 2 kg of the toner base particles A, and mixed together in the Henschel blender for 15 minutes at a speed of 40 m/s (speed of the front edge of rotating blades), to obtain a toner A. Subsequently, the toner A in the amount of 30 g and the carrier A in the amount of 300 g were mixed together in a ball mill for 30 minutes, to prepare a developer A.

(Preparation of Developer B)

In place of the resin fine particles A in the amount of 20 g, the resin fine particles B in the amount of 20 g were added to the toner base particles A and mixed together in the Henschel blender for 5 minutes at 40 m/s, to obtain a toner B. Subsequently, the toner B in the amount of 30 g and the carrier A in the amount of 300 g were mixed together in the ball mill for 30 minutes, to prepare a developer B.

(Preparation of Developer C)

A toner C was obtained in the same manner as how the toner A was obtained, except that the resin fine particles C in the amount of 20 g were added in place of 20 g of the resin fine particles A. Subsequently, the toner C in the amount of 30 g and the carrier A in the amount of 300 g were mixed together in the ball mill for 30 minutes, to prepare a developer C.

(Preparation of Developer D)

A toner D was obtained in the same manner as how the toner A was obtained, except for mixing in the Henschel blender for 5 minutes. Subsequently, the toner D in the amount of 30 g and the carrier A in the amount of 300 g were mixed together in the ball mill for 30 minutes, to prepare a developer D.

(Preparation of Developer E)

A toner E was obtained in the same manner as how the toner A was obtained, except that the resin fine particles B in the amount of 20 g were added in place of 20 g of the resin fine particles A. Subsequently, the toner E in the amount of 30 g and the carrier A in the amount of 300 g were mixed together in the ball mill for 30 minutes, to prepare a developer E.

(Preparation of Developer F)

In place of the resin fine particles A in the amount of 20 g, the resin fine particles D in the amount of 20 g were added to the toner base particles A and mixed together in the Henschel blender for 5 minutes at 40 m/s, to obtain a toner F. Subsequently, the toner F in the amount of 30 g and the carrier A in the amount of 300 g were mixed together in the ball mill for 30 minutes, to prepare a developer F.

(Preparation of Developer G)

In place of the resin fine particles A in the amount of 20 g, the resin fine particles D in the amount of 20 g were added to the toner base particles A and mixed together in the Henschel blender for 10 minutes at 30 m/s, to obtain a toner G. Subsequently, the toner G in the amount of 30 g and the carrier A in the amount of 300 g were mixed together in the ball mill for 30 minutes, to prepare a developer G.

(Preparation of Developer H)

In place of the resin fine particles A in the amount of 20 g, the resin fine particles C in the amount of 20 g were added to the toner base particles A and mixed together in the Henschel blender for 10 minutes at 30 m/s, to obtain a toner H. Subsequently, the toner H in the amount of 30 g and the carrier A in the amount of 300 g were mixed together in the ball mill for 30 minutes, to prepare a developer H.

(Preparation of Developer I)

In place of the resin fine particles A in the amount of 20 g, the resin fine particles B in the amount of 20 g were added to the toner base particles A and mixed together in the Henschel blender for 5 minutes at 30 m/s, to obtain a toner I. Subsequently, the toner I in the amount of 30 g and the carrier A in the amount of 300 g were mixed together in the ball mill for 30 minutes, to prepare a developer I.

(Preparation of Developer J)

A toner J was obtained in the same manner as how the toner A was obtained, except for mixing in the Henschel blender for 20 minutes at 40 m/s. Subsequently, the toner J in the amount of 30 g and the carrier A in the amount of 300 g were mixed together in the ball mill for 30 minutes, to prepare a developer J.

(Preparation of Developer K)

In place of the resin fine particles A in the amount of 20 g, the resin fine particles E in the amount of 20 g were added to the toner base particles A and mixed together in the Henschel blender for 5 minutes at 40 m/s, to obtain a toner K. Subsequently, the toner K in the amount of 30 g and the carrier A in the amount of 300 g were mixed together in the ball mill for 30 minutes, to prepare a developer K.

(Preparation of Developer L)

In place of the resin fine particles A in the amount of 20 g, the resin fine particles F in the amount of 20 g were added to the toner base particles A and mixed together in the Henschel blender for 5 minutes at 40 m/s, to obtain a toner L. Subsequently, the toner L in the amount of 30 g and the carrier A in the amount of 300 g were mixed together in the ball mill for 30 minutes, to prepare a developer L.

[Evaluation]

(Particle Diameter Etc. of Resin Fine Particles)

The surface of the 10 particles of the toner were photographed from the side using the field emission electron scanning microscope JSM-7401F (manufactured by JEOL Ltd.) at an electron beam accelerating voltage of 0.5 Kv and 100,000-fold magnification. The values of a, b and c were measured to calculate an average value.

In the following measurement on fogging, the amount of carrier spent, and sleeve resistance, the developers A to L prepared in the manners described above (the developers A to F correspond to Examples 1 to 6, and the developers G to L correspond to Comparative Examples 1 to 6) were placed on a digital color complex machine of Kyocera Mita Japan Corporation (product name: "TASKalfa 500ci") and evaluated under the following conditions.

(Image Fogging Concentration)

The maximum fogging value was measured by a spectroeye reflectance density meter by GretagMacbeth when printing document sheets exhibiting a 20% print ratio after continuously printing 3,000 of document sheets with a 0.2% print ratio. The maximum fogging value of 0.008 or less is considered acceptable.

(Amount of Carrier Spent)

After continuously printing 300,000 document sheets with a 5% print ratio, the toner of the developer used for this printing was filtered by a 635 mesh and suctioned and removed by a vacuum. The carbon content of the separated carrier was measured using Carbon Analyzer EMIA-110 of Horiba, Ltd. The carbon content less than 1.1% is considered acceptable.

(Developing Sleeve Resistance)

After continuously printing 300,000 document sheets of 5% print ratio, the surface resistance of a central part of the developing sleeve was measured by application of 10 V by using a high resistivity measuring instrument, HIRESTA MCP-HT450 (manufactured by Mitsubishi Chemical Corporation). The surface resistance within a range of $1\times10^5\Omega/\square$ to $5\times10^7\Omega/\square$ is considered acceptable.

The results of the evaluation test performed as described above are shown in Table 1.

TABLE 1

| | | RESIN FINE PARTICLES | | | | | | | | | | AMOUNT | SLEEVE |
|---|---|---|---|---|---|---|---|---|---|---|---|---|---|
| | SAMPLE NAME | TYPE | PARTICLE DIAMETER (nm) | AGGREGATION OF PARTICLES | a (nm) | b (nm) | c (nm) | b/a (—) | c/a (—) | FOGGING (—) | OF CARRIER SPENT (%) | SURFACE RESISTANCE (Ω/□) |
| EXAMPLE 1 | TONER A | RESIN FINE PARTICLE A | 65 | NONE | 105 | 25 | 76 | 0.24 | 0.72 | 0.002 | 0.66 | $1.1 * 10^7$ |
| EXAMPLE 2 | TONER B | RESIN FINE PARTICLE B | 93 | NONE | 117 | 58 | 90 | 0.50 | 0.77 | 0.001 | 0.61 | $1.2 * 10^7$ |
| EXAMPLE 3 | TONER C | RESIN FINE PARTICLE C | 52 | NONE | 87 | 19 | 58 | 0.22 | 0.67 | 0.003 | 0.46 | $1.0 * 10^7$ |
| EXAMPLE 4 | TONER D | RESIN FINE PARTICLE A | 65 | NONE | 83 | 40 | 61 | 0.48 | 0.73 | 0.002 | 0.81 | $1.6 * 10^7$ |
| EXAMPLE 5 | TONER E | RESIN FINE PARTICLE B | 93 | NONE | 158 | 32 | 117 | 0.20 | 0.74 | 0.004 | 0.87 | $1.8 * 10^7$ |
| EXAMPLE 6 | TONER F | RESIN FINE PARTICLE D | 123 | NONE | 155 | 77 | 121 | 0.50 | 0.78 | 0.003 | 1.02 | $3.6 * 10^7$ |
| COMPARATIVE EXAMPLE 1 | TONER G | RESIN FINE PARTICLE D | 123 | NONE | 165 | 69 | 127 | 0.42 | 0.77 | 0.003 | 2.21 | $5.8 * 10^8$ |
| COMPARATIVE EXAMPLE 2 | TONER H | RESIN FINE PARTICLE C | 52 | NONE | 69 | 29 | 45 | 0.42 | 0.65 | 0.017 | 0.56 | $1.2 * 10^7$ |
| COMPARATIVE EXAMPLE 3 | TONER I | RESIN FINE PARTICLE B | 93 | NONE | 114 | 61 | 88 | 0.54 | 0.77 | 0.004 | 2.04 | $3.7 * 10^8$ |
| COMPARATIVE EXAMPLE 4 | TONER J | RESIN FINE PARTICLE A | 65 | NONE | 118 | 20 | 84 | 0.17 | 0.71 | 0.015 | 0.82 | $2.5 * 10^7$ |
| COMPARATIVE EXAMPLE 5 | TONER K | RESIN FINE PARTICLE E | 80 | PRESENT | | | | | | 0.012 | 0.57 | $1.9 * 10^7$ |
| COMPARATIVE EXAMPLE 6 | TONER L | RESIN FINE PARTICLE F | 88 | NONE | 113 | 57 | 95 | 0.50 | 0.84 | 0.002 | 2.95 | $6.4 * 10^8$ |

As is clear from Table 1, no fogging was observed when using any of the toners A to F (Examples 1 to 6) in which the level of deformation of the resin fine particles fixed to the toner surfaces was within the range described in the present disclosure. The amount of carrier spent in each of these toners was within the acceptable range. Moreover, the surface resistance of the developing sleeve when using each of these toners was good.

On the other hand, toners which are outside the range described in the present disclosure in terms of their level of deformation when fixed to the toner surfaces, i.e., G to J and L (Comparative Examples 1 to 4 and 6) as well as the toner K (Comparative Example 5), in which resin fine particles were coagulated as a lump, were evaluated as unacceptable since when using these toners unacceptable levels of image fogging or carrier spend amounts were exhibited. In Comparative Examples 1, 3 and 6 showing significantly high amount of carrier spent, the surface resistance of the developing sleeve was also high.

As described above, it is clear that stable image quality can be maintained over a long period of time by setting the level of deformation of the resin fine particles fixed to the toner surfaces, within the range described in the present disclosure.

According to the configurations of the toners described above, the fluidity of each toner can be enhanced and defective charging by the inorganic fine particles can be favorably prevented by externally adding the resin fine particles and the inorganic fine particles to the toner. In addition, appropriately fixing the deformed resin fine particles to the toner surfaces can prevent the resin fine particles from adhering to the developing sleeve and the photosensitive drum. Therefore, both defective charging and contamination of the toner carriers can be prevented, stabilizing the quality of an image over a long period of time.

This application is based on Japanese Patent application No. 2010-197942 filed in Japan Patent Office on Sep. 3, 2010, the contents of which are hereby incorporated by reference.

Although the present invention has been fully described by way of example with reference to the accompanying drawing, it is to be understood that various changes and modifications will be apparent to those skilled in the art. Therefore, unless otherwise such changes and modifications depart from the scope of the present invention hereinafter defined, they should be construed as being included therein.

What is claimed is:

1. An electrostatic charge developing toner in which resin fine particles and inorganic fine particles are externally added to toner base particles, wherein the toner base particles include at least binder resin and colorant, the resin fine particles are monodispersed and fixed to surfaces of the toner base particles, and following equations are established:

$a$=70 to 160 nm, $b/a$=0.2 to 0.5, and $c/a$=0.6 to 0.8, where "a" represents an average of diameters (nm) of circular surfaces of contact between the fixed resin fine particles and toner base particle surfaces, "b" represents an average of heights (nm) of the resin fine particles from the contact surfaces, and "c" represents an average diameter (nm) of the resin fine particles at the height b/2.

2. The electrostatic charge developing toner according to claim 1, wherein an amount of the resin fine particles added is 0.05 to 2 parts by mass with respect to 100 parts by mass of the toner base particles, and an amount of the inorganic fine particles added is 0.4 to 10 parts by mass with respect to 100 parts by mass of the toner base particles.

3. The electrostatic charge developing toner according to claim 1, wherein the resin fine particles are at least one selected from a group consisting of styrene-acrylic resin fine particles, polyacrylic amide resin fine particles, polyvinyl chloride resin fine particles, and urethane resin fine particles.

4. The electrostatic charge developing toner according to claim 1, wherein an average primary particle diameter of the resin fine particles is 40 to 140 nm.

5. The electrostatic charge developing toner according to claim 1, wherein the inorganic fine particles are silica particles.

6. An electrostatic charge developing developer, comprising electrostatic charge developing toner according to claim 1 and a carrier.

7. An image forming apparatus, which uses the electrostatic charge developing developer according to claim 6.

8. An image forming apparatus, which was the electrostatic charge developing toner according to claim 1.

* * * * *